US009859107B1

(12) United States Patent
Kim

(10) Patent No.: US 9,859,107 B1
(45) Date of Patent: Jan. 2, 2018

(54) ELECTRODELESS LIGHTING SYSTEM INCLUDING REFLECTOR

(71) Applicant: RFHIC CORPORATION, Anyang-Si, Gyeonggi-Do (KR)

(72) Inventor: Cheol Jun Kim, Suwon-Si (KR)

(73) Assignee: RFHIC CORPORATION (KR)

( * ) Notice: Subject to any disclaimer, the term of this patent is extended or adjusted under 35 U.S.C. 154(b) by 0 days.

(21) Appl. No.: 15/358,115

(22) Filed: Nov. 21, 2016

Related U.S. Application Data

(60) Provisional application No. 62/394,158, filed on Sep. 13, 2016.

(51) Int. Cl.

| | |
|---|---|
| ***H01Q 1/26*** | (2006.01) |
| ***H01J 61/52*** | (2006.01) |
| ***H01J 65/04*** | (2006.01) |
| ***H01J 61/02*** | (2006.01) |

(52) U.S. Cl.
CPC ..... *H01J 65/044* (2013.01); *H01J 61/025* (2013.01); *H01J 61/52* (2013.01)

(58) Field of Classification Search
CPC ..... H01J 65/044; H01J 61/025; H01J 61/52
USPC ..... 315/34
See application file for complete search history.

(56) References Cited

U.S. PATENT DOCUMENTS

2005/0122049 A1* 6/2005 Lee ..... H01J 65/044 315/39.51
2009/0284166 A1* 11/2009 DeVincentis ..... H01J 65/044 315/248
2012/0249010 A1* 10/2012 Hollingsworth ... H05B 41/2806 315/248

FOREIGN PATENT DOCUMENTS

| | | | |
|---|---|---|---|
| JP | 2003022786 | A | 1/2003 |
| JP | 2003257208 | A | 9/2003 |
| JP | 2015069740 | A | 4/2015 |
| KR | 19900000359 | B1 | 1/1990 |
| KR | 200356282 | A | 7/2004 |
| KR | 20120030423 | A | 3/2012 |
| KR | 20150089183 | A | 8/2015 |
| KR | 20150089184 | A | 8/2015 |

* cited by examiner

*Primary Examiner* — Daniel D Chang
(74) *Attorney, Agent, or Firm* — Renaissance IP Law Group LLP

(57) ABSTRACT

Provided is an electrodeless lighting system including a solid state power amplifier (SSPA) configured to generate a microwave having a predetermined frequency, a resonator having a shielding structure configured to shield the microwave having a predetermined frequency so as to prevent the microwave from being discharged to the outside of the resonator, a connector configured to connect the SSPA to the resonator, an antenna configured to discharge the microwave having the predetermined frequency, which is generated in the SSPA, to the resonator, a bulb disposed in the resonator and including a light emitting material that is excited by the microwave having the predetermined frequency to emit light, and a support configured to support the bulb. Here, the antenna is a conductor introduced into the resonator through the connector.

14 Claims, 2 Drawing Sheets

ELECTRODELESS LIGHTING SYSTEM INCLUDING REFLECTOR

CROSS-REFERENCE TO RELATED APPLICATION

This application claims priority to U.S. Provisional Patent Application No. 62/394,158 filed on Sep. 13, 2016 and all the benefits accruing therefrom under 35 U.S.C. §119, the contents of which are incorporated by reference in their entirety.

BACKGROUND

The present disclosure relates to an electrodeless lighting system, and more particularly, to an electrodeless lighting system in which a microwave reflector and a light reflector are integrated with each other to resonate by directly discharging microwave into a resonator through an antenna.

In general, in an electrodeless lighting system, microwave energy generated by a microwave generation part for generating microwave is transferred to a resonator through a waveguide to excite a filling material of an electrodeless bulb provided in the resonator, during which a filling gas of the electrodeless bulb is converted into a plasma state and the filled material is excited to emit light.

The electrodeless lighting system has a lifetime that is very long or semi-permanent because it uses an electrodeless bulb without an electrode or a filament. In addition, the filling material filled in the electrodeless bulb is plasmized to emit light like natural light.

Also, the electrodeless lighting system may be called a cutting-edge lighting system that saves energy and maintenance costs through high quantity of light and light speed maintenance rate, has a high lifetime, efficiency, and color rendering property by using an electrodeless light source, and does not use mercury not to harm environment and a human body.

Due to the above-described advantages, the electrodeless lighting system has been spotlighted in a lighting market for sports such as a soccer field, a golf course, and a baseball park. Also, the market expands to a field such as plant cultivation due to light source characteristics, and the electrodeless lighting system has been developing as a next generation green energy because it has the lifetime greater than that of LED.

However, a typical electrodeless lighting system has a complex structure in which a microwave reflecting reflector and a light reflecting reflector are separately provided. Furthermore, microwave loss occurs while the microwave passes through the light reflecting reflector.

PRIOR ART DOCUMENTS

Patent Documents

Korean Laid-Open Patent Gazette No. 2015-0089183
Korean Laid-Open Patent Gazette No. 2015-0089184

SUMMARY

The present disclosure provides an electrodeless lighting system having a simple structure in which a microwave reflecting reflector and a light reflecting reflector are integrated with each other to prevent microwave loss caused by the light reflecting reflector.

The present invention also provides an electrodeless lighting system directly discharging microwave into a resonator.

In accordance with an exemplary embodiment, an electrodeless lighting system includes: a solid state power amplifier (SSPA) configured to generate a microwave having a predetermined frequency; a resonator having a shielding structure configured to shield the microwave having a predetermined frequency so as to prevent the microwave from being discharged to the outside of the resonator; a connector configured to connect the SSPA to the resonator; an antenna configured to discharge the microwave having the predetermined frequency, which is generated in the SSPA, to the resonator; a bulb disposed in the resonator and including a light emitting material that is excited by the microwave having the predetermined frequency to emit light; and a support configured to support the bulb, and the antenna is a conductor introduced into the resonator through the connector.

In accordance with another exemplary embodiment, an electrodeless lighting system includes: a magnetron configured to generate a microwave having a predetermined frequency; a resonator having a shielding structure configured to shield the microwave having the predetermined frequency so as to prevent the microwave from being discharged to the outside of the resonator; a connector configured to connect the magnetron to the resonator; an antenna configured to discharge the microwave having the predetermined frequency, which is generated in the magnetron, to the resonator; a bulb disposed in the resonator and including a light emitting material excited by the microwave having the predetermined frequency to emit light; and a support configured to support the bulb, and the antenna is a conductor introduced into the resonator through the connector.

The resonator may have a polyhedral structure of which one side surface is connected to the connector and at least one surface in the polyhedral structure is a reflective surface made of a material that reflects light.

For example, the resonator may have a hexahedral structure of which one side surface is connected to the connector and at least one surface in the hexahedral structure is a reflective surface made of a material that reflects light.

The connector may be an SMA connector or a microwave connector.

The antenna may be one of a dipole antenna, a monopole antenna, and a patch antenna.

The resonator may have surfaces, each of which has a hexagonal mesh structure, except for the reflective surface to shield the microwave having the predetermined frequency so as to prevent the microwave from being discharged to the outside of the resonator and transmit light generated in the bulb.

The reflective surface may be directly manufactured by using a metal that reflects light or manufactured through a chemical deposition or plating method.

The reflective surface may be connected to at least one heat sink that is separately provided, or the reflective surface and at least one heat sink may be integrated with each other.

The at least one heat sink may be connected to a heat-pipe to dissipate heat through natural convection.

The at least one heat sink may be connected to a heat-pipe and further include a separated fan.

BRIEF DESCRIPTION OF THE DRAWINGS

Exemplary embodiments can be understood in more detail from the following description taken in conjunction with the accompanying drawings, in which.

Figure 2:
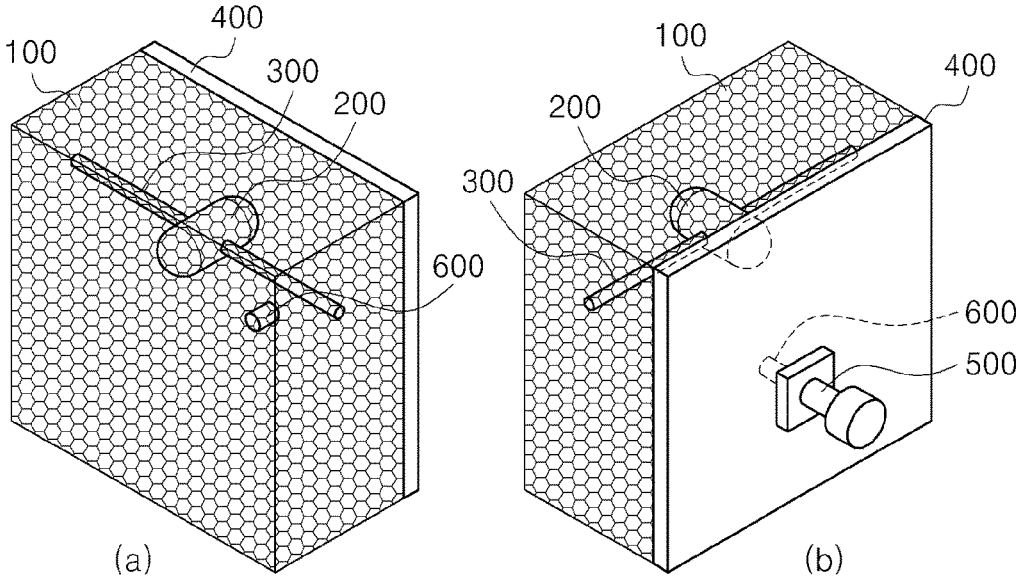
Figure 3:
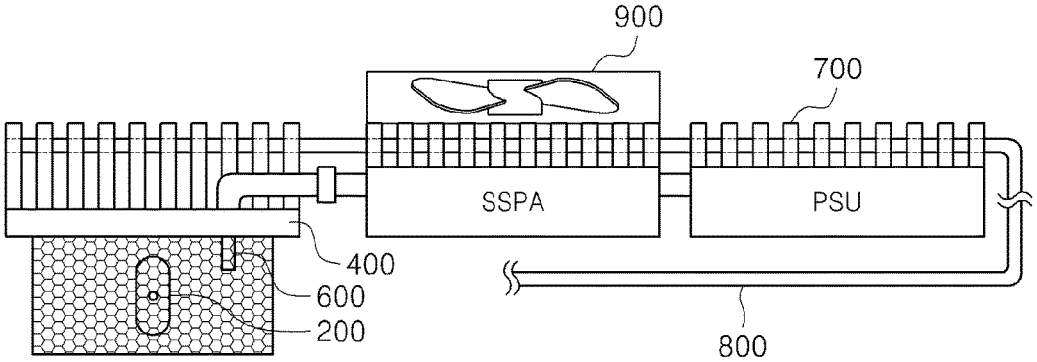
Figure 4:
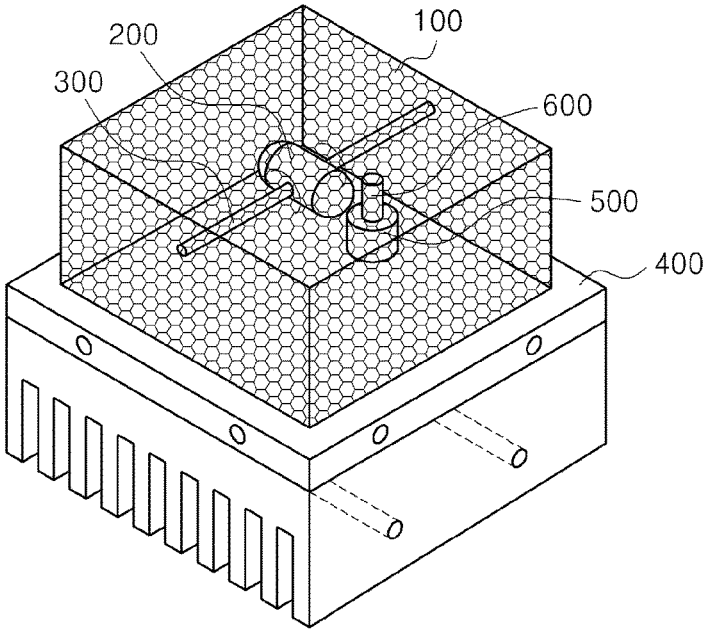

(a) and (b) of FIG. 2 are front and side views illustrating a resonator of the electrodeless lighting system in accordance with an exemplary embodiment;

FIG. 3 is a configuration view illustrating an entire electrodeless lighting system to which a heat sink is attached in accordance with an exemplary embodiment; and FIG. 4 is a configuration view illustrating an entire electrodeless lighting system in which a heat sink is integrated in accordance with an exemplary embodiment.

DETAILED DESCRIPTION OF EMBODIMENTS

Hereinafter, preferred embodiments of the present invention will be described in detail with reference to the accompanying drawings in such a manner that the technical idea of the present invention may easily be carried out by a person with ordinary skill in the art to which the invention pertains. The present invention may, however, be embodied in many different forms and should not be construed as being limited to the embodiments set forth herein. In the drawings, anything unnecessary for describing the present disclosure will be omitted for clarity, and also like reference numerals in the drawings denote like elements.

It will be understood that although the terms of first and second are used herein to describe various elements, these elements should not be limited by these terms. The terms are only used to distinguish one component from other components. For example, a first element referred to as a first element in one embodiment can be referred to as a second element in another embodiment. In the following description, the technical terms are used only for explaining a specific exemplary embodiment while not limiting the present disclosure. The terms of a singular form may include plural forms unless referred to the contrary.

In this disclosure below, when one part (or element, device, etc.) is referred to as being 'connected' to another part (or element, device, etc.), it should be understood that the former can be 'directly connected' to the latter, or 'electrically connected to the latter via an intervening part (or element, device, etc.). Furthermore, when it is described that one comprises (or includes or has) some elements, it should be understood that it may comprise (or include or has) only those elements, or it may comprise (or include or have) other elements as well as those elements if there is no specific limitation. Terms of degree used throughout the specification such as "~step" or "a step of~" do not represent "a step for~".

Although, for the terms used in the present disclosure, general terms widely currently used have been selected as possible as they can, the terms can be changed according to intention of those skilled in the art, precedents, and the advent of new technologies. Also, in a specific case, terms arbitrarily selected by an applicant may be used. In this case, since the meaning thereof is described in detail in the detailed description of the specification, the present disclosure should be understood in an aspect of meaning of such terms, not the simple names of such terms.

Furthermore, when it is described that one comprises (or includes or has) some elements, it should be understood that it may comprise (or include or has) only those elements, or it may comprise (or include or have) other elements as well as those elements if there is no specific limitation.

Figure 1:
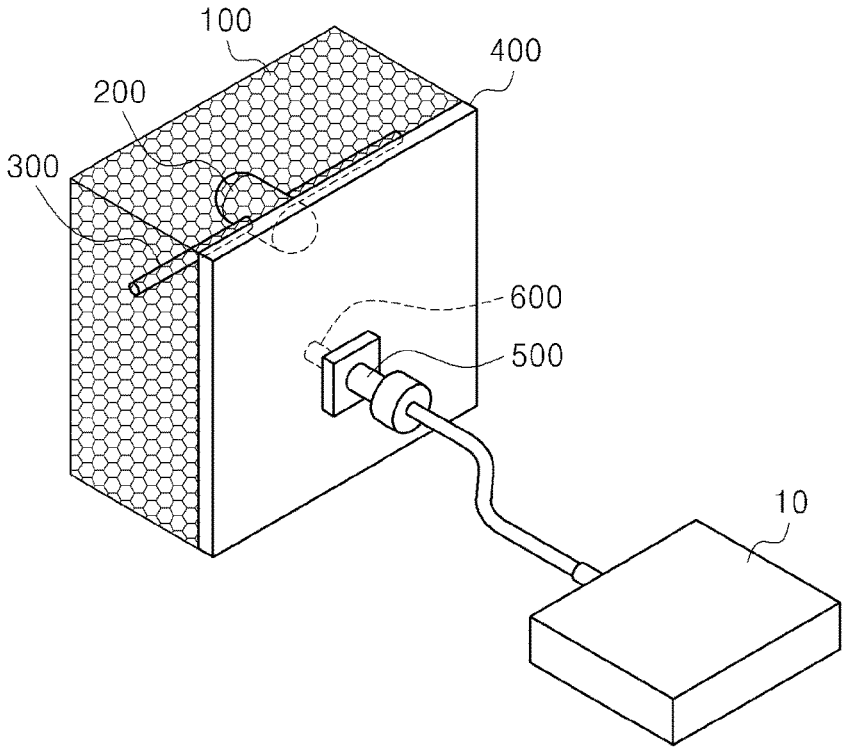
FIG. 1 is a configuration view illustrating an electrodeless lighting system in accordance with an exemplary embodiment.

Hereinafter, an electrodeless lighting system in accordance with an exemplary embodiment will be described with reference to FIG. 1.

The electrodeless lighting system in accordance with an exemplary embodiment may include a solid state power amplifier (SSPA) 10 for generating microwave having a predetermined frequency, a resonator 100 having a shielding structure for shielding the microwave having a predetermined frequency so as to prevent the microwave from being discharged to the outside of the resonator, a connector 500 connecting the SSPA 10 to the resonator 100, an antenna 600 discharging the microwave having a predetermined frequency, which is generated in the SSPA 10, to the resonator 100, a bulb 200 disposed in the resonator and including a light emitting material excited by the microwave having a predetermined frequency to emit light, and a support 300 having one side connected to the bulb 200 and the other side connected to the resonator 100. The antenna 600 may be a conductor introduced into the resonator 100 through the connector 500.

In more detail, when power is provided to the SSPA 10 and a microwave signal is provided at a desired driving voltage, the SSPA 10 may be oscillated by the driving voltage and generate the microwave having a predetermined frequency.

The above-described SSPA 10 may be replaced by a magnetron (not shown) in accordance with an exemplary embodiment.

Hereinafter, the resonator in accordance with an exemplary embodiment will be described with reference to FIG. 2.

The resonator 100 may have a polyhedral structure in which the connector 500 is connected to one surface of numerous surfaces thereof, and at least one surface thereof is a reflective surface 400 including a reflective material reflecting light.

For example the resonator 100 may have a hexahedral structure in which the connector 500 is connected to one surface of six surfaces thereof, and at least one surface thereof is a reflective surface 400 including a reflective material reflecting light.

In more detail, the other surfaces among the six surfaces of the resonator 100 except for the reflective surface 400 may have a hexagonal mesh structure to shield the microwave having a predetermined frequency, which is generated in the SSPA 10 or the magnetron (not shown), so as to prevent the microwave from being discharged to the outside of the resonator 100 and transmit light generated in the bulb 200.

Meanwhile, the reflective surface 400 may be directly manufactured by using metal reflecting light or through various methods such as a chemical deposition or plating method.

Meanwhile, the reflective surface 400 may be coupled to at least one heat sink 700 that is separately provided as illustrated in FIG. 3 or integrated with at least one heat sink 700 as illustrated in FIG. 4.

In more detail, the at least one heat sink 700 may be connected to a heat-pipe 800 to improve heat dissipation efficiency through natural convection.

Also, the at least one heat sink may be connected to the heat pipe 800 and further include a separated fan to further improve the heat dissipation efficiency.

Here, a size of the resonator may be designed on the basis of an equation 1 below.

$$f_{mnp} = \frac{c}{2\pi}\sqrt{\left(\frac{m\pi}{a}\right)^2 + \left(\frac{n\pi}{b}\right)^2 + \left(\frac{p\pi}{d}\right)^2}$$

(where, $f_{map}$: resonant frequency in TEmnp and TMmnp, m,n,p: degree of resonant mode, a: length of the resonant, b: width of the resonant, c: height of the resonant)

In accordance with an exemplary embodiment, when the resonant is designed to have a=3.6 cm, b=6.7 cm, c=15 cm, the resonant having a resonant structure of a TE101 mode at 2.45 GHz.

Also, the connector 500 may include a SMA connector or a microwave connector. For example, the connector 500 may include a 1.85 mm connector, a 2.4 mm connector, a 2.92 mm connector, an N series connector, a TNC connector, a BNC connector, F series and G series connectors, a DIN connector, an OSMP connector, a SMB connector, a MCX connector, a SSMT connector, an OSMT connector, and a MMXC connector.

The bulb 200 may have a structure transmitting light generated therein and preventing the light emitting material in the bulb from leaking to the outside, and be made of quartz, Pyrex, ceramic, or sapphire.

Also, the bulb 200 may have a closed space therein and further include a buffer gas in addition to the light emitting material filled in the bulb.

Here, the buffer gas includes a gas filled in the bulb to have weak reactivity or almost no reactivity. The buffer gas helps an initial start-up of the electrodeless bulb and allows the light emitting material to stably exist. The buffer gas used herein may include an inert gas such as xenon, argon, neon, and Krypton, Meanwhile, the light emitting material is filled in the bulb. According to the kind of the material filled in the bulb, the light excited and emitted by the microwave may have a different wavelength. Also, the light emitting material may be not a single material but a mixed material. According to the combination of the mixed light emitting material, the light may have various wavelengths.

The antenna 600 may include a dipole antenna, a monopole antenna, and a patch antenna. When the bulb has an oval shape, the antenna may be designed in a direction parallel to a major axis of the bulb.

In accordance with an exemplary embodiment, when the antenna 600 is manufactured as the dipole antenna, the dipole antenna may be manufactured by bending two conductive lines, which have polarities different from each other, to have a total length as same as a half (212) of the wavelength, thereby having an omni-directional beam pattern.

In accordance with another exemplary embodiment, when the antenna 600 is manufactured as the monopole antenna, one side thereof may be manufactured as a ground (earth) instead of a conductor, and the length of the antenna may be $\lambda/4$.

In accordance with still another exemplary embodiment, when the antenna 600 is manufactured as the patch antenna, the antenna 600 may be manufacture as a rectangular or circular shaped metal pattern on a substrate to realize miniaturization and lightening.

The support 300 may perform a function of fixing the bulb 200 to an inside of the resonator 100 and discharging the heat generated in the bulb 200. The support 300 may be made of quartz and glass and have one side connected to the bulb 200 and the other side connected to one side surface of the resonator 100.

The above-described support 300 may have various shapes such as a circle or a polygonal pillar, and be provided in plurality.

For example, in accordance with an exemplary embodiment, the bulb 200 may have an oval shape having a minor axis and a major axis, and, here, the support 300 may extend from a central portion of the major axis of the bulb and be installed in a direction perpendicular to the major axis.

The reason of the above-described configuration is as follows. In case of the oval shaped bulb, when heat is generated at the central portion of the bulb due to excitation of a compound, vaporized compound may be condensed on an outer portion, which has a relatively low temperature, of the major axis of the bulb. Here, when the support is provided on the outer portion extending to the major axis of the bulb, the heat may be transferred through the support to generate imbalance in heat distribution of the bulb. To prevent this, when the bulb has the oval shape, the support is desirably installed at the central portion of the major axis of the bulb in the direction perpendicular to the major axis.

Also, a plurality of supports may be spaced a predetermined distance from each other to firmly fix the bulb, thereby improving the heat dissipation effect.

In accordance with the exemplary embodiment, the electrodeless lighting system having the simple structure in which the microwave reflecting reflector and the light reflecting reflector are integrated with each other to prevent the microwave loss caused by the light reflecting reflector may be manufactured.

Also, in accordance with the exemplary embodiment, the electrodeless lighting system directly discharging the microwave into the resonator through the antenna may be manufactured.

As described above, the technical idea of the present invention has been specifically described with respect to the above embodiments, but it should be noted that the foregoing embodiments are provided only for illustration while not limiting the present invention. Various embodiments may be provided to allow those skilled in the art to understand the scope of the preset invention, but the present invention is not limited thereto.

What is claimed is:

1. An electrodeless lighting system comprising:

a solid state power amplifier (SSPA) configured to generate a microwave having a predetermined frequency;

a resonator having a shielding structure configured to shield the microwave having a predetermined frequency so as to prevent the microwave from being discharged to the outside of the resonator;

a connector configured to connect the SSPA to the resonator;

an antenna configured to discharge the microwave having the predetermined frequency, which is generated in the SSPA, to the resonator;

a bulb disposed in the resonator and comprising a light emitting material that is excited by the microwave having the predetermined frequency to emit light; and a support configured to support the bulb, wherein the antenna is a conductor introduced into the resonator through the connector, wherein the resonator has a hexahedral structure of which one side surface is connected to the connector and at least one surface in the hexahedral structure is a reflective surface made of a material that reflects light, wherein the resonator has surfaces, each of which has a hexagonal mesh structure, except for the reflective surface to shield the microwave having the predetermined frequency so as to prevent the microwave from being discharged to the outside of the resonator and transmit light generated in the bulb.

2. The electrodeless lighting system of claim 1, wherein the connector is an SMA connector or a microwave connector.

3. The electrodeless lighting system of claim 1, wherein the antenna is one of a dipole antenna, a monopole antenna, and a patch antenna.

4. The electrodeless lighting system of claim 1, wherein the reflective surface is directly manufactured by using a metal that reflects light or manufactured through a chemical deposition or plating method.

5. The electrodeless lighting system of claim 1, wherein the reflective surface is connected to at least one heat sink that is separately provided, or the reflective surface and at least one heat sink are integrated with each other.

6. The electrodeless lighting system of claim 5, wherein the at least one heat sink is connected to a heat-pipe to dissipate heat through natural convection.

7. The electrodeless lighting system of claim 5, wherein the at least one heat sink is connected to a heat-pipe and further comprises a separated fan.

8. An electrodeless lighting system comprising:

a magnetron configured to generate a microwave having a predetermined frequency;

a resonator having a shielding structure configured to shield the microwave having the predetermined frequency so as to prevent the microwave from being discharged to the outside of the resonator;

a connector configured to connect the magnetron to the resonator;

an antenna configured to discharge the microwave having the predetermined frequency, which is generated in the magnetron, to the resonator;

a bulb disposed in the resonator and comprising a light emitting material excited by the microwave having the predetermined frequency to emit light; and a support configured to support the bulb, wherein the antenna is a conductor introduced into the resonator through the connector, wherein the resonator has a hexahedral structure of which one side surface is connected to the connector and at least one surface in the hexahedral structure is a reflective surface made of a material that reflects light, wherein the resonator has surfaces, each of which has a hexagonal mesh structure, except for the reflective surface to shield the microwave having the predetermined frequency so as to prevent the microwave from being discharged to the outside of the resonator and transmit light generated in the bulb.

9. The electrodeless lighting system of claim 8, wherein the connector is an SMA connector or a microwave connector.

10. The electrodeless lighting system of claim 8, wherein the antenna is one of a dipole antenna, a monopole antenna, and a patch antenna.

11. The electrodeless lighting system of claim 8, wherein the reflective surface is directly manufactured by using a metal that reflects light or manufactured through a chemical deposition or plating method.

12. The electrodeless lighting system of claim 8, wherein the reflective surface is connected to at least one heat sink that is separately provided, or the reflective surface and at least one heat sink are integrated with each other.

13. The electrodeless lighting system of claim 12, wherein the at least one heat sink is connected to a heat-pipe to dissipate heat through natural convection.

14. The electrodeless lighting system of claim 12, wherein the at least one heat sink is connected to a heat-pipe and further comprises a separated fan.

* * * * *